US011937667B2

(12) United States Patent
Yang et al.

(10) Patent No.: US 11,937,667 B2
(45) Date of Patent: Mar. 26, 2024

(54) SPIKE STRUCTURE MADE OF DIFFERENT MATERIALS

(71) Applicants: Teng-Jen Yang, Taichung (TW); Jen-Yu Yang, Taichung (TW)

(72) Inventors: Teng-Jen Yang, Taichung (TW); Jen-Yu Yang, Taichung (TW)

( * ) Notice: Subject to any disclaimer, the term of this patent is extended or adjusted under 35 U.S.C. 154(b) by 0 days.

(21) Appl. No.: 17/822,221

(22) Filed: Aug. 25, 2022

(65) Prior Publication Data

US 2024/0065384 A1 Feb. 29, 2024

(51) Int. Cl.

| | |
|---|---|
| ***A43B 13/22*** | (2006.01) |
| ***A43C 13/04*** | (2006.01) |
| ***A43C 15/16*** | (2006.01) |

(52) U.S. Cl.

CPC ..... *A43C 13/04* (2013.01); *A43B 13/223* (2013.01); *A43C 15/161* (2013.01)

(58) Field of Classification Search

CPC ..... A43B 13/04; A43B 15/16; A43B 15/161; A43B 15/168; A43B 13/223

See application file for complete search history.

(56) References Cited

U.S. PATENT DOCUMENTS

| | | | | |
|---|---|---|---|---|
| 2007/0251128 | A1* | 11/2007 | Yen | A43C 15/161 36/134 |
| 2010/0107450 | A1* | 5/2010 | Locke | A43C 15/02 36/62 |
| 2013/0139412 | A1* | 6/2013 | Auger | A43B 13/184 36/25 R |
| 2013/0318831 | A1* | 12/2013 | Foxen | A43B 13/223 12/146 B |
| 2013/0340295 | A1* | 12/2013 | Adami | A43B 13/04 12/146 B |
| 2016/0113357 | A1* | 4/2016 | Yang | A43B 5/02 12/142 T |
| 2016/0114546 | A1* | 4/2016 | Yang | B29D 35/122 12/146 B |

* cited by examiner

*Primary Examiner* — Sharon M Prange
(74) *Attorney, Agent, or Firm* — Wang Law Firm, Inc.

(57) ABSTRACT

A spike structure made of different materials includes: a sole protruding portion, an interface member and a cleat member. The interface member is disposed between the sole protruding portion and the cleat member, so that the sole protruding portion does not directly contact the cleat member, but the sole protruding portion and the cleat member are in contact with the interface member, and because the interface member is easily bonded to the cleat member, the interface member and the cleat member can be fixedly combined by bonding. Besides, the interface member and the sole protruding portion are made of hard materials with similar hardness and are not easily deformed when they are in contact with each other. Therefore, the interface member and the sole protruding portion are not easily slipped off.

3 Claims, 4 Drawing Sheets

SPIKE STRUCTURE MADE OF DIFFERENT MATERIALS

BACKGROUND

Field of the Invention

The present invention relates to a spike structure of a shoe, and more particularly to a spike structure made of different materials.

Description of Related Art

The spikes can be applied to sports such as football, American football, baseball, etc. Please refer to FIGS. 1 and 2, the outsole 70 includes a plurality of spikes 71, and the spikes 71 do not have bolts. The conventional spikes 71 each include a sole protruding portion 711 and a cleat 712. The sole protruding portion 711 is a part of the outsole 70. The sole protruding portion 711 is integrally formed with the outsole 70 and includes a space 713, and the cleat 712 is disposed in the space 713 and partially protrudes out of the sole protruding portion 711. The sole protruding portion 711 and the cleat 712 are made of different materials. In order to ensure the support of the outsole 70, the hardness of the sole protruding portion 711 needs to be greater than that of the cleat 712. The conventional sole protruding portion 711 is made of polypropylene (PP), and the cleat 712 is made of thermoplastic polyurethane (TPU), however, because polypropylene (PP) is a crystalline plastic, it has the characteristics of good chemical resistance and chemical resistance, so it is not easy to combine and stick with other plastic materials, and even polypropylene (PP) is particularly difficult to bond with thermoplastic polyurethane (TPU).

Therefore, please refer to FIG. 3A, when the conventional spiked shoes are in use, the cleat easily deformed due to the external flexing force, causing the cleat 712 to come out of the space 713. Please refer to FIG. 3B, if the cleat 712 is subjected to an external flexing force when the space 713 is filled with the cleat 712, the cleat 712 is likely to break from where the cleat 712 is exposed out of and jointed with the sole protruding portion 711, thereby causing damage to the spiked shoe. Therefore, there is a need for a shoe spike structure made of different materials that is not easy to damage and fall off.

SUMMARY

The present invention is to provide a spike structure made of different materials, the main objective of which is to stabilize the bonding of the different material-made spike, and the spike won't fall off or be damaged easily.

To achieve the above objective, a spike structure made of different materials is provided by the invention for connecting with a body, the spike structure comprises:

a sole protruding portion provided for connecting with the body, the sole protruding portion surrounding to form a space, and the sole protruding portion including a bottom section and a protruding section connected to each other, the bottom section being connected to the body, an extension direction of the bottom section being different from that of the protruding section, wherein an end of the protruding section that is not connected to the bottom section includes an end surface, a side surface of the protruding section facing the space is a vertical surface, a first angle is defined between the end surface and the vertical surface;

an interface member including a first section and a second section connected to each other, and the first section and the second section extending in different directions, the first section including a first inner surface and a first outer surface opposite to each other, the first inner surface of the first section being attached to the end surface, the second section extending into the space, the second section including a second inner surface and a second outer surface opposite to each other, the second inner surface being attached to the vertical surface, and the interface member being made of a hard material; and a cleat member including a head portion and an extension portion connected to each other, the head portion being located outside the space, the extension portion extending into the space, an end of the head portion connected to the extension portion includes a stepped surface attached to the first outer surface of the first section, the extension portion including an outer peripheral surface attached to the second outer surface, a hardness of the cleat member being smaller than that of the interface member and the sole protruding portion.

In the present invention, the interface member is disposed between the sole protruding portion and the cleat member, so that the sole protruding portion does not directly contact the cleat member, but the sole protruding portion and the cleat member are in contact with the interface member, and because the interface member is easily bonded to the cleat member, the interface member and the cleat member can be fixedly combined by bonding. Besides, the interface member and the sole protruding portion are made of hard materials with similar hardness and are not easily deformed when they are in contact with each other. Therefore, the interface member and the sole protruding portion are not easily slipped off.

DETAILED DESCRIPTION

Figure 1:
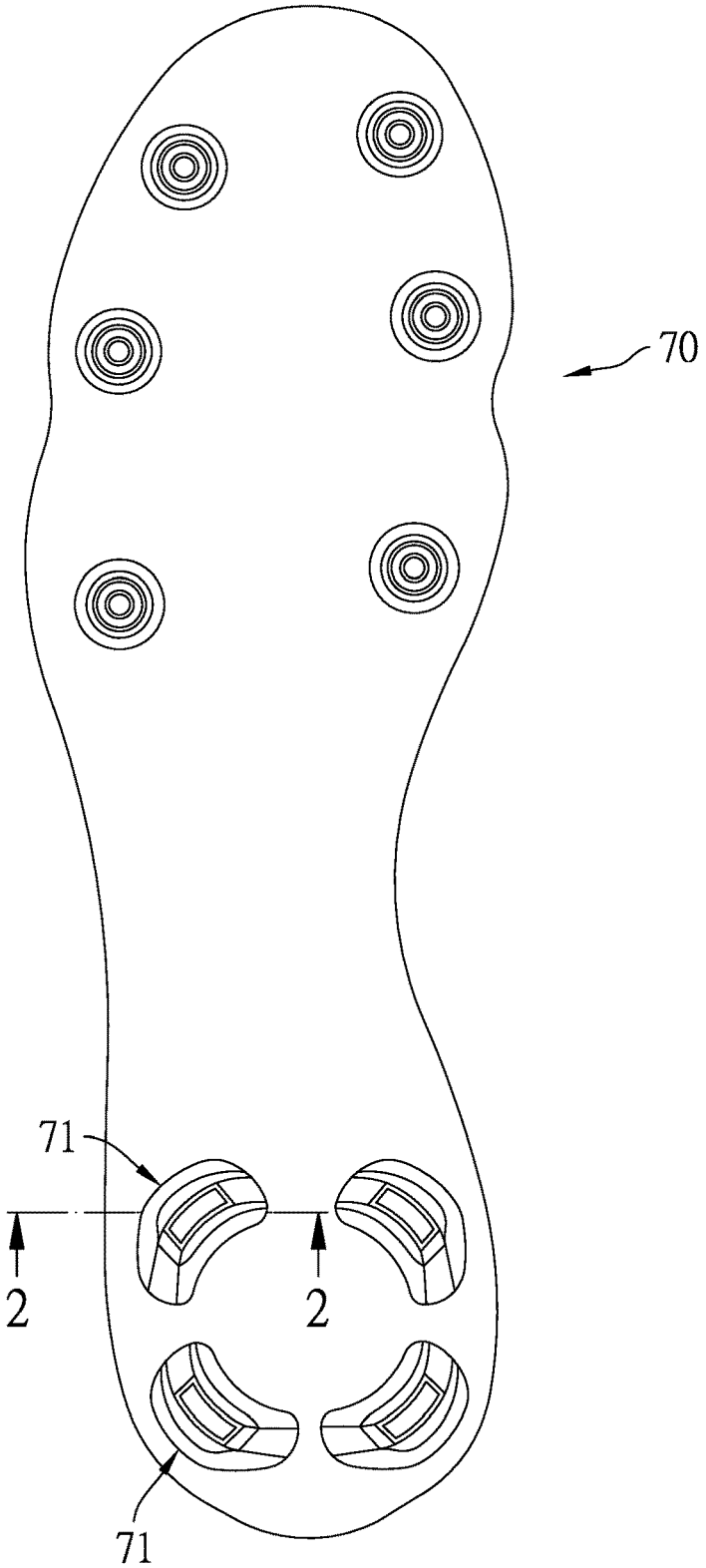
FIG.1 PRIOR ART
FIG. 1 is a schematic diagram of a conventional shoe sole.
Figure 2:
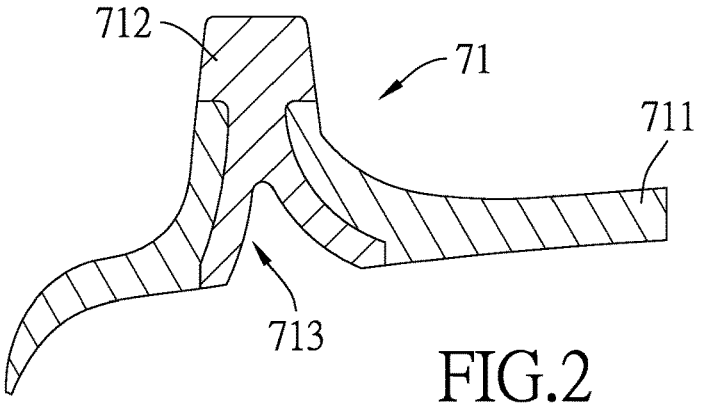
FIG.2 PRIOR ART
FIG. 2 is a sectional view taken along line 2-2 of FIG. 1.
Figure 3A:
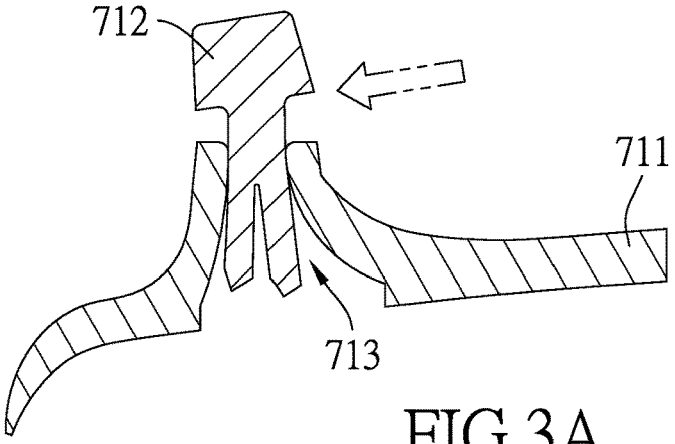
FIG.3A PRIOR ART
FIG. 3A is a schematic diagram of a conventional shoe spike falling off due to external force.
Figure 3B:
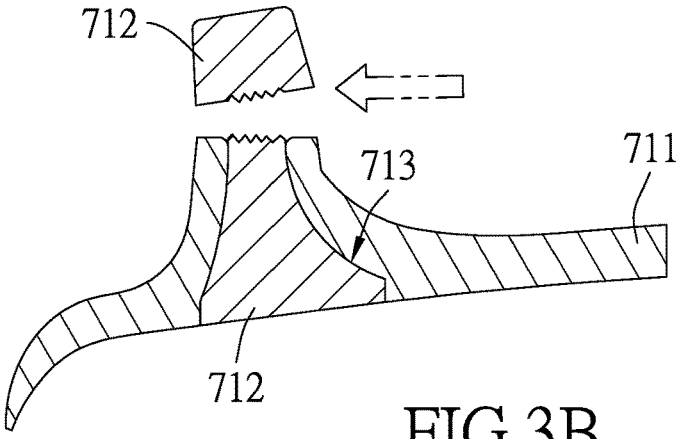
FIG.3B PRIOR ART
FIG. 3B is a schematic diagram of the conventional shoe spike breaking due to external force.
Figure 4:
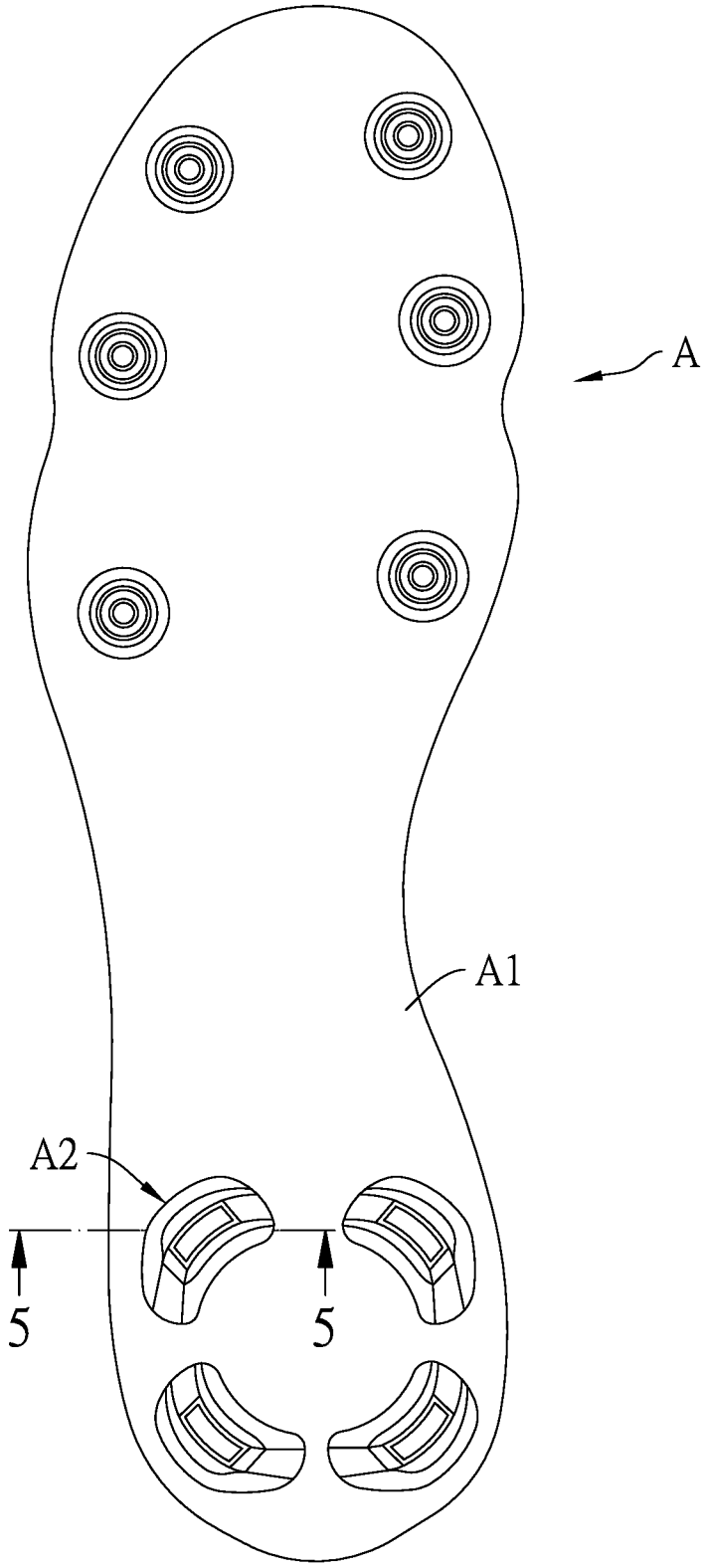
FIG. 4 is a schematic diagram of the sole of the present invention.
Figure 5:
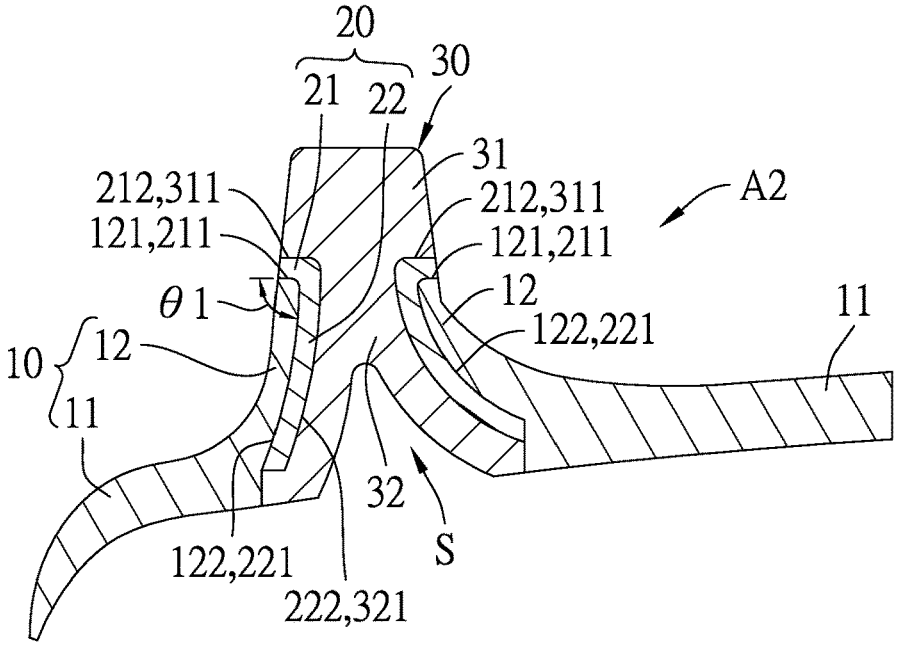
FIG. 5 is a cross-sectional view taken along line 5-5 of FIG. 4.

The present invention provides a spike structure A2 made of different materials for connecting with a body A1 of an outsole A, please refer to FIGS. 4 and 5, and the spike structure A2 includes: a sole protruding portion 10, an interface member 20 and a cleat member 30.

The sole protruding portion 10 is provided for connecting with the body A1, and the sole protruding portion 10 and the body A1 are integrally formed and made of the same material. The sole protruding portion 10 surrounds to form a space S, and includes a bottom section 11 and a protruding section 12 connected to each other. The bottom section 11 is connected to the body A1, the extension direction of the bottom section 11 is roughly the same as that of the body A1, and both are parallel to the ground. The extension direction of the bottom section 11 is different from that of the protruding section 12, so that the protruding section 12 protrudes out of the body A1. The end of the protruding section 12 that is not connected to the bottom section 11 includes an end surface 121. A side surface of the protruding section 12 facing the space S is a vertical surface 122, there is a first angle θ1 between the end surface 121 and the vertical surface 122, and the first angle θ1 is between 90 degrees and 70 degrees. In this embodiment, the material of the sole protruding portion 10 can be polypropylene (PP), but not limited to this.

The interface member 20 includes a first section 21 and a second section 22 connected to each other, and the first section 21 and the second section 22 extend in different directions. The first section 21 includes a first inner surface 211 and a first outer surface 212 opposite to each other. The first inner surface 211 of the first section 21 is attached to the end surface 121, and the second section 22 extends into the space S, and includes a second inner surface 221 and a second outer surface 222 opposite to each other. The second inner surface 221 is attached to the vertical surface 122. The interface member 20 is made of a hard material, the hardness of the interface member 20 is the same as that of the sole protruding portion 10, and the material of the interface member 20 can be selected from a group consisting of polycarbonate (PC), ABS resin (Acrylonitrile Butadiene Styrene), thermoplastic polyurethane (TPU) with a hardness of 55D~75D (Shore hardness), a mixture of ABS resin and TPU, in which the content of ABS resin accounts for about 30~50% of the whole mixture, a mixture of TPU and glass fiber (GF), in which the content of glass fiber accounts for about 20~30% of the whole mixture, a mixture of polycarbonate (PC) and ABS resin, in which the content of ABS resin accounts for about 10~50% of the whole mixture, nylon elastomer (Pebax), material Models such as PA10, PA11, PA12, or a mixture of nylon elastomer (Pebax) and glass fiber (GF), material models such as BZM8, BZM7, GF8, but not limited to this. In this embodiment, the Shore hardness of the interface member 20 is between 55D and 75D.

The cleat member 30 includes a head portion 31 and an extension portion 32 connected to each other. The head portion 31 is located outside the space S, and the extension portion 32 extends into the space S. The cross-sectional area of the head portion 31 is larger than that of the extension portion 32, so an end of the head portion 31 connected to the extension portion 32 has a stepped surface 311, and the stepped surface 311 is attached to the first outer surface 212 of the first section 21. The extension portion 32 includes an outer peripheral surface 321, and the outer peripheral surface 321 is attached to the second outer surface 222. The hardness of the cleat member 30 is smaller than that of the interface member 20 and the sole protruding portion 10. The material of the cleat member 30 can be thermoplastic polyurethane (TPU). In this embodiment, the Shore hardness of the cleat member 30 is between 90A and 98A, due to the material property of the interface member 20 and the cleat member 30 have similar material properties, the interface member 20 and the cleat member 30 can be fused and adhered to each other when they are successively injection-molded.

Figure 6:
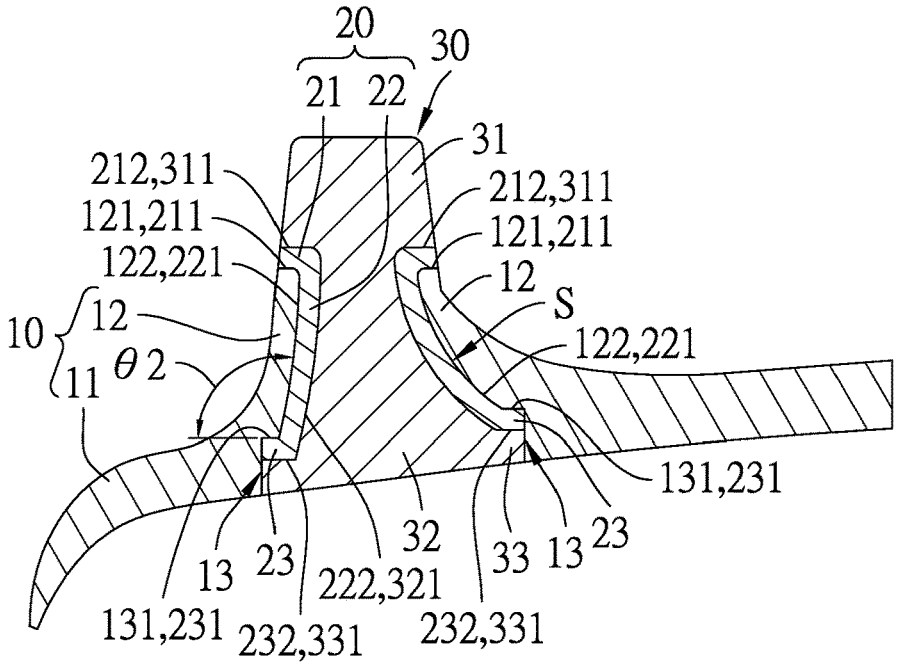
FIG. 6 is a schematic cross-sectional view of another embodiment of the present invention.

In a preferred embodiment, please refer to FIG. 6, the sole protruding portion 10 further includes a groove 13 which can be located in the bottom section 11 or the protruding section 12. The groove 13 is communicated with the space S and includes an abutting end surface 131, the extension direction of the abutting end surface 131 and the extension direction of the end surface 121 are almost parallel, and the extension direction of the abutting end surface 131 is different from that of the vertical surface 122. There is a second angle θ2 between the abutting end surface 131 and the vertical surface 122, and the second angle θ2 is between 90 degrees and 70 degrees.

The interface member 20 further includes a third section 23, and the third section 23 is connected to the end of the second section 22 that is not connected to the first section 21, so that one end of the second section 22 is connected to the first section 21, and the other end of the second section 22 is connected to the third section 23. The extension direction of the third section 23 is different from that of the second section 22, and the extension direction of the third section 23 is parallel to that of the first section 21. The third section 23 includes a third inner surface 231 and a third outer surface 232 opposite to each other, and the third inner surface 231 is abutted against the abutting end surface 131.

The cleat member 30 further includes an engaging portion 33, the engaging portion 33 is connected to an end of the extension portion 32 that is not connected to the head portion 31, and a cross-sectional area of the engaging portion 33 is larger than that of the extension portion 32. Therefore, a side of the engaging portion 33 connected to the extension portion 32 includes an engaging surface 331, and the engaging surface 331 is abutted against the third outer surface 232.

The above is the configuration description of the main components of each embodiment of the present invention, and the description of the effect of the present invention is as follows.

In the present invention, the interface member 20 is disposed between the sole protruding portion 10 and the cleat member 30, so that the sole protruding portion 10 does not directly contact the cleat member 30, but the sole protruding portion 10 and the cleat member 30 are in contact with the interface member 20, and because the interface member 20 is easily bonded to the cleat member 30, the interface member 20 and the cleat member 30 can be fixedly combined by bonding. Besides, the interface member 20 and the sole protruding portion 10 are made of hard materials with similar hardness and are not easily deformed when they are in contact with each other. Therefore, the interface member 20 and the sole protruding portion 10 are not easily slipped off.

In addition, since the protruding section 12 of the sole protruding portion 10 has the end surface 121 and the vertical surface 122, the end surface 121 and the vertical surface 122 define the first angle θ1 therebetween, the first section 21 and the second section 22 of the interface member 20 extend in different directions, the first inner surface 211 of the first section 21 is attached to the end surface 121, the second inner surface 221 is attached to the vertical surface 122, so that the sole protruding portion 10 and the interface member 20 are engaged or bonded in different directions to enhance the stability of the combination. Similarly, the stepped surface 311 of the cleat member 30 is attached to the first outer surface 212 of the first section 21, and the outer peripheral surface 321 of the cleat member 30 is attached to the second outer surface 222, so that the cleat member 30 and the interface member 20 are engaged in different directions to improve the stability of the combination of the two.

Further, since the sole protruding portion 10 includes the groove 13, the abutting end surface 131 of the groove 13 and the vertical surface 122 define the second angle θ2, and the interface member 20 further includes the third section 23, the third inner surface 231 of the third section 23 abuts against the abutting end face 131, the cleat member 30 further includes the engaging portion 33, and a side of the engaging portion 33 connected to the extension portion 32 has the abutting surface 331, and the abutting surface 331 is abutted against the third outer surface 232, so that the sole protruding portion 10 and the interface member 20, and the interface member 20 and the cleat member 30 can be engaged or bonded in different directions, so as to improve the stability of the combination of the sole protruding portion 10, the interface member 20 and the cleat member 30.

What is claimed is:

1. A spike structure made of different materials for connecting with a body, the spike structure comprising:

a sole protruding portion provided for connecting with the body, the sole protruding portion including a space, and the sole protruding portion including a bottom section and a protruding section connected to each other, an extension direction of the bottom section being different from that of the protruding section, wherein an end of the protruding section that is not connected to the bottom section includes an end surface, a side surface of the protruding section facing the space is a vertical surface, a first angle θ is defined between the end surface and the vertical surface, and a material of the sole protruding portion is polypropylene;

an interface member including a first section and a second section connected to each other, and the first section and the second section extending in different directions, the first section including a first inner surface and a first outer surface opposite to each other, the first inner surface of the first section being attached to the end surface, the second section extending into the space, the second section including a second inner surface and a second outer surface opposite to each other, the second inner surface being attached to the vertical surface, and the interface member being made of a hard material with a Shore hardness of 55D~75D; and a cleat member including a head portion and an extension portion connected to each other, the head portion being located outside the space, the extension portion extending into the space, an end of the head portion connected to the extension portion includes a stepped surface attached to the first outer surface of the first section, the extension portion including an outer peripheral surface attached to the second outer surface, a hardness of the cleat member being smaller than that of the interface member and the sole protruding portion, and a material of the cleat member is thermoplastic polyurethane;

wherein the sole protruding portion further includes a groove, the groove includes an abutting end surface, the abutting end surface and the vertical surface extend in different directions, a second angle is formed between the abutting end surface and the vertical surface, the interface member further includes a third section, the third section is connected to an end of the second section that is not connected to the first section, the third section and the second section extend in different directions, the third section includes a third inner surface and a third outer surface opposite to each other, and the third inner surface is abutted against the abutting end surface.

2. The spike structure made of different materials as claimed in claim 1, wherein the hard material of the interface member is selected from a group consisting of polycarbonate, Acrylonitrile Butadiene Styrene resin, thermoplastic polyurethane with a hardness of 55D~75D, a mixture of Acrylonitrile Butadiene Styrene resin and thermoplastic polyurethane, a mixture of thermoplastic polyurethane and glass fiber, a mixture of polycarbonate and Acrylonitrile Butadiene Styrene resin, nylon elastomer, and a mixture of nylon elastomer and glass fiber.

3. The spike structure made of different materials as claimed in claim 1, wherein the cleat member further includes an engaging portion, the engaging portion is connected to an end of the extension portion that is not connected to the head portion, a side of the engaging portion connected to the extension portion includes an engaging surface, and the engaging surface is abutted against the third outer surface.

* * * * *